US005600562A

United States Patent [19]

Guenther

[11] Patent Number: 5,600,562

[45] Date of Patent: Feb. 4, 1997

[54] METHOD FOR THE OPERATION OF A POSTAGE METER MACHINE

[75] Inventor: Stephan Guenther, Berlin, Germany

[73] Assignee: Francotyp-Postalia AG & Co., Birkenwerder, Germany

[21] Appl. No.: 339,888

[22] Filed: Nov. 14, 1994

[30] Foreign Application Priority Data

Dec. 16, 1993 [EP] European Pat. Off. ..... 93 120 344.2

[51] Int. Cl.[6] ..... G07B 17/00

[52] U.S. Cl. ..... 364/464.11; 283/71; 283/74; 283/75

[58] Field of Search ..... 283/71, 74, 75; 364/464.02

[56] References Cited

U.S. PATENT DOCUMENTS

| | | | |
|---|---|---|---|
| 4,511,793 | 4/1985 | Racanelli | 364/464.03 |
| 4,812,994 | 3/1989 | Taylor et al. | 364/464.02 |
| 4,831,554 | 5/1989 | Storace et al. | 364/464.02 X |
| 4,868,757 | 9/1989 | Gil | 364/464.03 |
| 4,914,606 | 4/1990 | Vermesse | 364/464.02 |
| 5,038,153 | 8/1991 | Liechti et al. | 346/75 X |
| 5,166,883 | 11/1992 | Gilham | 364/464.02 |
| 5,168,804 | 12/1992 | Lee et al. | 101/99 |
| 5,365,044 | 11/1994 | Hesshaus | 235/375 |
| 5,471,925 | 12/1995 | Heinrich et al. | 364/464.02 X |
| 5,490,077 | 2/1996 | Freytag | 364/464.02 |

FOREIGN PATENT DOCUMENTS

| | | |
|---|---|---|
| 0566225 | 10/1993 | European Pat. Off. . |
| 0405357 | 1/1991 | France . |
| 4107030 | 9/1992 | Germany . |
| WO92/07338 | 4/1992 | WIPO . |

*Primary Examiner*—Edward R. Cosimano
*Attorney, Agent, or Firm*—Hill, Steadman & Simpson

[57] ABSTRACT

In a method for the operation of a postage meter machine jointly by a plurality of users, at least one message is allocated to each user and has at least one identifier that identifies the respective user to which the message is allocated. A control unit in the machine is supplied by a current user with information about that user's identifier when put into use. The control unit compares the information to the identifier and automatically uses the message allocated to the current user when imprinting postal matter for that user.

21 Claims, 7 Drawing Sheets

METHOD FOR THE OPERATION OF A POSTAGE METER MACHINE

BACKGROUND OF THE INVENTION

1. Field of the Invention

The invention is directed to a method for the operation of a postage meter machine, whereby the postage meter machine is used in common by a plurality of users, whereby at least one message (text, graphics, logo, slogan, etc., sometimes referred to as a "cliché") is allocated to each user.

2. Description of the Prior Art

There is often the desire in smaller undertakings such as, for example, joint offices of free-lancers, craft and service companies to handle the dispatch of mail at a central location and to use the postal equipment in common. Costs and work processes can be saved as a result of the joint use.

The advertising message to be printed on the postal matter, referred to below merely as a message, should also contain particulars in addition to general advertising information with which the undertaking of the user is specifically referenced. At least one message is thus to be provided per user. Since the message should also frequently carry advertising information, for example greetings at Easter, Christmas, etc., or should indicate specific services of the respective user, a plurality of messages are generally to be offered per user, or are to be resupplied by the manufacture during the course of the service life of a postage meter machine.

When purchasing a postage meter machine that can be used jointly by a plurality of users, one message is usually offered at the factory per user, this being activatable by pressing a key. If only one user would like to modify his message, then this new message is produced in the factory and the message data are stored in a read-only memory, for example an EPROM. This read-only memory is sent to the user who plugs it into an open plug-in location of the postage meter machine provided for that purpose. The machine preparation for using this new message, however, are not yet completed. The user must also inform the control unit of the postage meter machine that a new message is specifically available for him and this can be activated by a specific input instruction. The conventional procedure, wherein the user must enter instructions in dialogue with the control, makes the initialization of a new message a complicated procedure that frequently leads to inquiries to the manufacturer and requires that the user be prepared to study the operating instructions of the postage meter machine. There is thus a need for a simple, user-friendly method for establishing a message.

A separate accounting of the postage stamp fees is frequently required by users. A specific cost center to which the fee increments and the fee debits are posted during franking is thus to be allocated to the message or messages of a user. It has already been proposed for this purpose to store the message data on a chip card on which the cost center number belonging to this message is also stored. The postage meter machine automatically enters the message data as well as the associated cost center and assigns a specific operating code to them. Manipulation with a chip card, however, is involved and requires great care on the part of the user.

German OS 37 12 100 discloses that a connection be set up between the postage meter machine and a central via a telephone modem. The message can be modified via this connection in a dialogue procedure between an input keyboard of the postage meter machine and a central computer.

The technological outlay is high given this solution and requires good knowledge of the postage meter machine and of the sequence of the dialogue on the part of the user.

SUMMARY OF THE INVENTION

An object of the invention is to provide a method for the operation of a postage meter machine for a plurality of users that enables the allocation of a message to a user in a user-friendly way.

This object is achieved in a method in accordance with the principles of the present invention wherein the message has at least one identifier that identifies the respective user; a control unit is supplied with reference information about the identifier, and the control unit compares the reference information to the identifier and, given agreement, automatically assigns the message to the user.

The invention is based on the consideration that it is in the interest of each user that his message contain an identifier that unambiguously identifies him, for example his name, his company slogan, his post office box, etc. When reference information about this identifier is supplied to the control unit, for example by manual entry of a company name or at least the initial letters thereof, then the control unit can determine whether the reference information is contained in the message. When there is agreement between the reference information and the identifier that identifies the user, the control unit can automatically assign the message to the respective user. The user thus need not undertake the allocation of the message in a complicated dialogue procedure with the postage meter machine, and as a result whereof the method of the invention is extremely user-friendly. The steps to be carried out by the factory and the user for establishing a new message are relatively simple: the user requests a message from the manufacturer of the postage meter machine; the data comprising the message are deposited in a read-only memory, for example in an EPROM, by the manufacturer as, for example, picture element data; the read-only memory is mailed to the user; the user inserts the read-only memory into the postage meter machine at a predetermined location; the control of the postage meter machine compares the identifier of the new message to that of the existing message or to manually entered information; when the compared identifiers agree, then the control automatically assigns the new message to the appertaining user; the implemented allocation is displayed to the user by the control.

If the various users of the same postage meter machine wish to have a separate charge registration, then a corresponding allocation of register sets wherein fee-related data are stored also ensues with the allocation of the message. The access to the respective register set then ensues dependent on the allocation of the message that has been undertaken. Since the user can be identified by the identifier in the message, misuse of messages of other users as well as of their cost centers can be easily recognized and countermeasures can be undertaken.

The information can be supplied to the control unit via the keyboard of the postage meter machine. For example, the operator enters the name of the user via the keyboard. The message is then examined in view of the textual content. When the entered name is present in the text, then the allocation to the appertaining user is undertaken. For monitoring, the message or at least the text part thereof can be displayed on a display field and can be confirmed by the operator.

In another embodiment of the invention, the identifier of a message that is already present that is employed as reference information, this being allocated to a specific user. When the identifiers of the existing message and of the new message agree, then the allocation can be undertaken. A manual entry of the reference information is then not required. The operating ease is further enhanced in this embodiment.

In another embodiment, the comparison of the reference information and the identifier ensues with reference to picture element data stored in a memory that are preferably arranged corresponding to the message to be printed. On the basis of this type of data arrangement, the agreement of the information and of the identifiers can be undertaken very quickly by employing statistical estimate methods in a data processing system.

For example, the cross-correlation method wherein the mathematical interconnection of two patterns to be compared is determined on the basis of a correlation factor is suitable for the implementation of the comparison. The correlation factor plus one thereby indicates complete agreement between the compared data. A correlation factor of zero indicates complete non-correlation of the compared data. In this embodiment, the allocation is undertaken dependent on the identified correlation factor. If the name of the user, for example, the company name, is employed as identifier, then a correlation factor of 0.8 suffices in order to assure adequate reliability for a correct allocation.

If no agreement between the identifier of the message and the reference information that are present either as manually entered information or as an identifier of messages already present is found, then an error signal is output by the control unit that signals an impermissible allocation of the message to a user. It is thereby assured that an allocation ensues only given adequate agreement.

DESCRIPTION OF THE PREFERRED EMBODIMENTS

Figure 1:
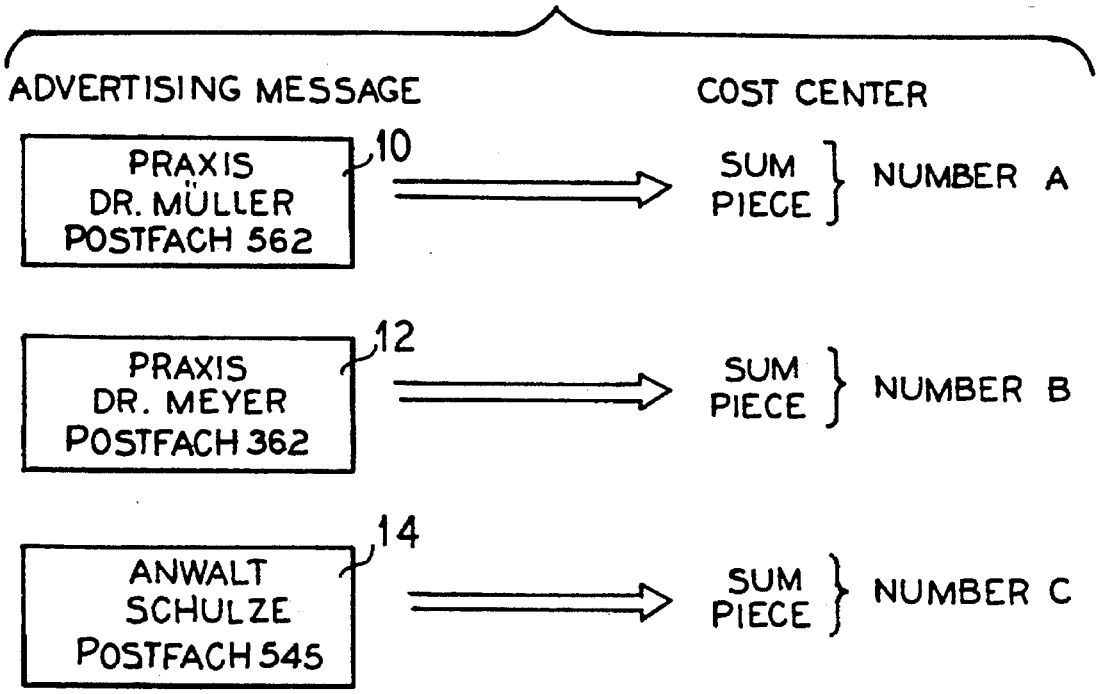
FIG. 1 shows advertising messages of three concerns who jointly use a postage meter machine but have separate cost centers.

FIG. 1 shows three advertising messages 10, 12, 14, each of which is respectively allocated to a private practice. The concerns jointly use a postage meter machine, whereby the costs incurred by each and every concern are to be separately registered. Accordingly, a cost center A is allocated to the concern having advertising message 10, a cost center B is allocated to the concern having advertising message 12, and a cost center C is allocated to the concern having advertising message 14. Technologically, the cost centers are fashioned as charge registers in the postage meter machine which respectively acquire, for its allocated user, the sum of used postal values and, potentially, further fee charges such as, for example, the current loaded condition of the postage meter machine with postage values, the postage values used over a specific time span, etc.

As can be seen in FIG. 1, the advertising messages 10, 12 and 14 contain coinciding text passages, for example "Postfach", as well as individualizing text passages such as, for example, the name of the respective owner of the concern or the P.O. Box number. When the concern "Schulze" would like to use a new advertising message in order, among other things, to indicate his concern, then the user will generally retain the individualizing test passages that distinguish him from other concerns and will merely modify of modernize those text passages that only indirectly indicate his concern. The advertising messages can be unambiguously allocated to a specific concern on the basis of these individual text passages, referred to below as an identifier. The instant invention utilizes this situation in order to fashion the setting procedure for a new advertising message in a user-friendly way and to implement the allocation to cost centers substantially automatically.

Figure 2:
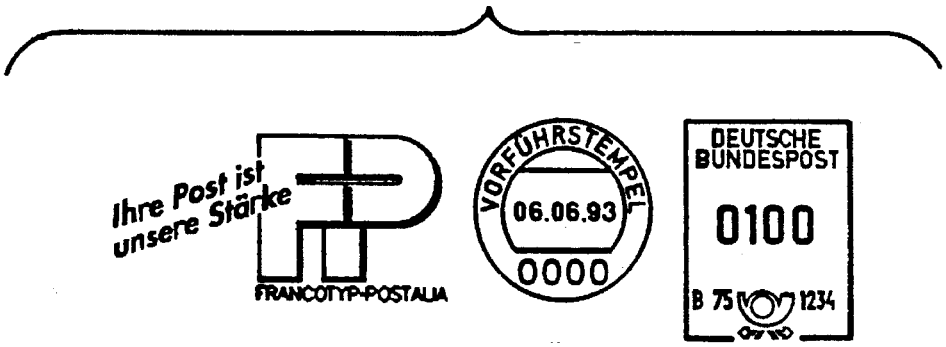
FIG. 2 illustrates the print format of the postage meter machine with a further advertising message.

FIG. 2 shows the structure of a relatively complex franking format of a postage meter machine. The postal value together with a recognition number for the postage meter machine are printed in the right part of the image. A stamp that contains the current date of the franking print is shown in the middle part of the image. An advertising message that contains the name of the company, a company logo (FP), an advertising message "Ihre Post ist unsere Stärke" as well as the mailing address is printed in the left part of the image. As in the case of most advertising messages, this mailing address is arranged as the last line of the text in the lower section of the image of the advertising message. It should be noted that the type sizes employed within the advertising message fluctuate greatly.

Figure 3:
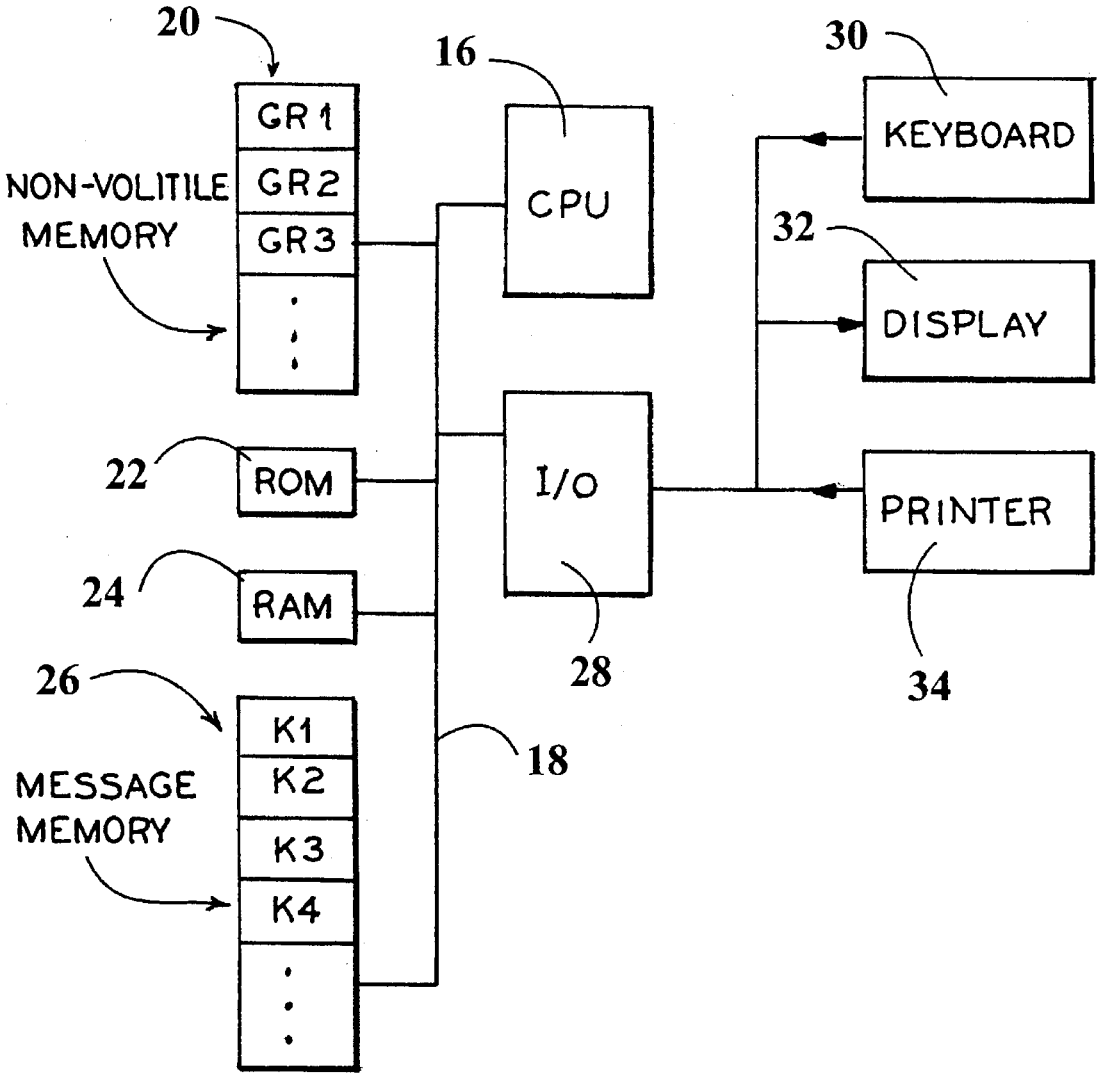
FIG. 3 is a block diagram of the basic function groups of a postage meter machine for practicing the method of the invention.

FIG. 3 shows a block diagram of the assemblies arranged in a postage meter machine, insofar as these are relevant to the present invention. Of course, a postage meter machine contains further assemblies that, however, have been omitted for clarity. The control of the postage meter machine is assumed by a microprocessor 16 to which a data bus 18 is connected. The microprocessor or CPU (central processing unit) 16 accesses a non-volatile memory 20, a read-only memory 22, a main memory 24, a message memory 26 fashioned as a read-only memory as well as an input/output interface 28 via this data bus 18. This input/output interface 28 produces the connection to a keyboard 30, to a display 32, as well as to a printer 34 for the franking image.

The memory 20 contains fee register sets GR1, GR2, GR3, etc., that physically form the cost centers for the various users of the postage meter machines. The user fee values, the fee values still present and further fee-related data are kept up to date in the fee register sets GR1, GR2, GR3. The read-only memory 22 contains programs for the control of the microprocessor 16, also including the program with which the method steps of the present invention are realized. The main memory 24 is fashioned as a read-write memory in which, for example, intermediate results are stored. The assemblies 16, 20, 22 and 24 are arranged in a security region of the postage meter machine and are not accessible from the outside. As a result, manipulations at the fee register sets GR1, GR2, GR3 are precluded.

The message memory 26 contains plug-in locations for EPROMs in which the printing data for the messages K1, K2, K3, K4, etc., employed in this postage meter machine are stored.

The manufacturer of the postage meter machine writes a new message into an EPROM in the form of printing data, the EPROM is sent to the user of the postage meter machine and the user inserts it into a free plug-in location of the message memory 26. The microprocessor 16 recognizes the occupation of the plug-in location and draws the attention of the user to the new message, or the user informs the control of his installation intent by entering an instruction.

Figure 4:
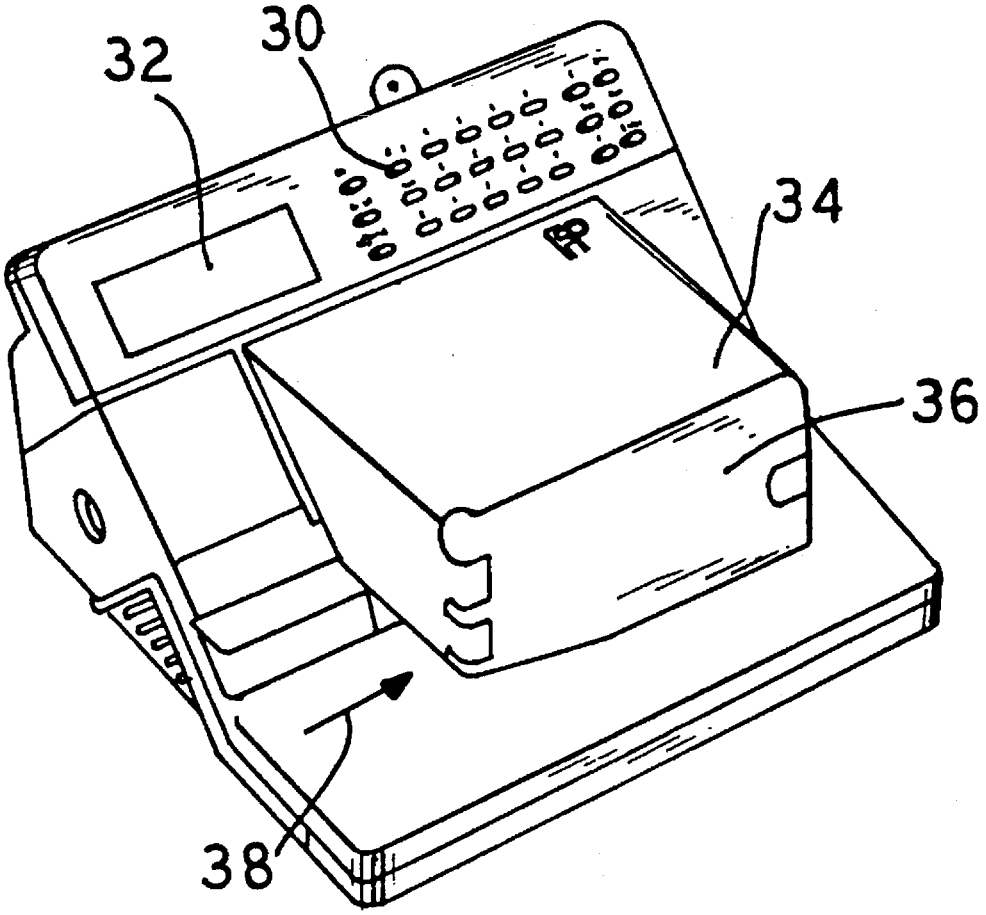
FIG. 4 is a front view of a postage meter machine with key field and display field.

FIG. 4 shows the front view of a postage meter machine wherein the invention is realized. The keyboard 30 has an alphanumerical key field via which alphanumerical characters are entered and can be displayed for checking on the display 32. The printer 34 is covered by a flap 36 that can be opened for maintenance purposes. During operation, the user selects a specific message via the keyboard 30, introduces postal matter to be franked in the arrow direction 38, this postal matter being printed with the franking image and with the advertising message by the printer 34. During this franking procedure, the cost center allocated to the selected message, i.e. the cost center of the respective user is charged.

Figure 5:
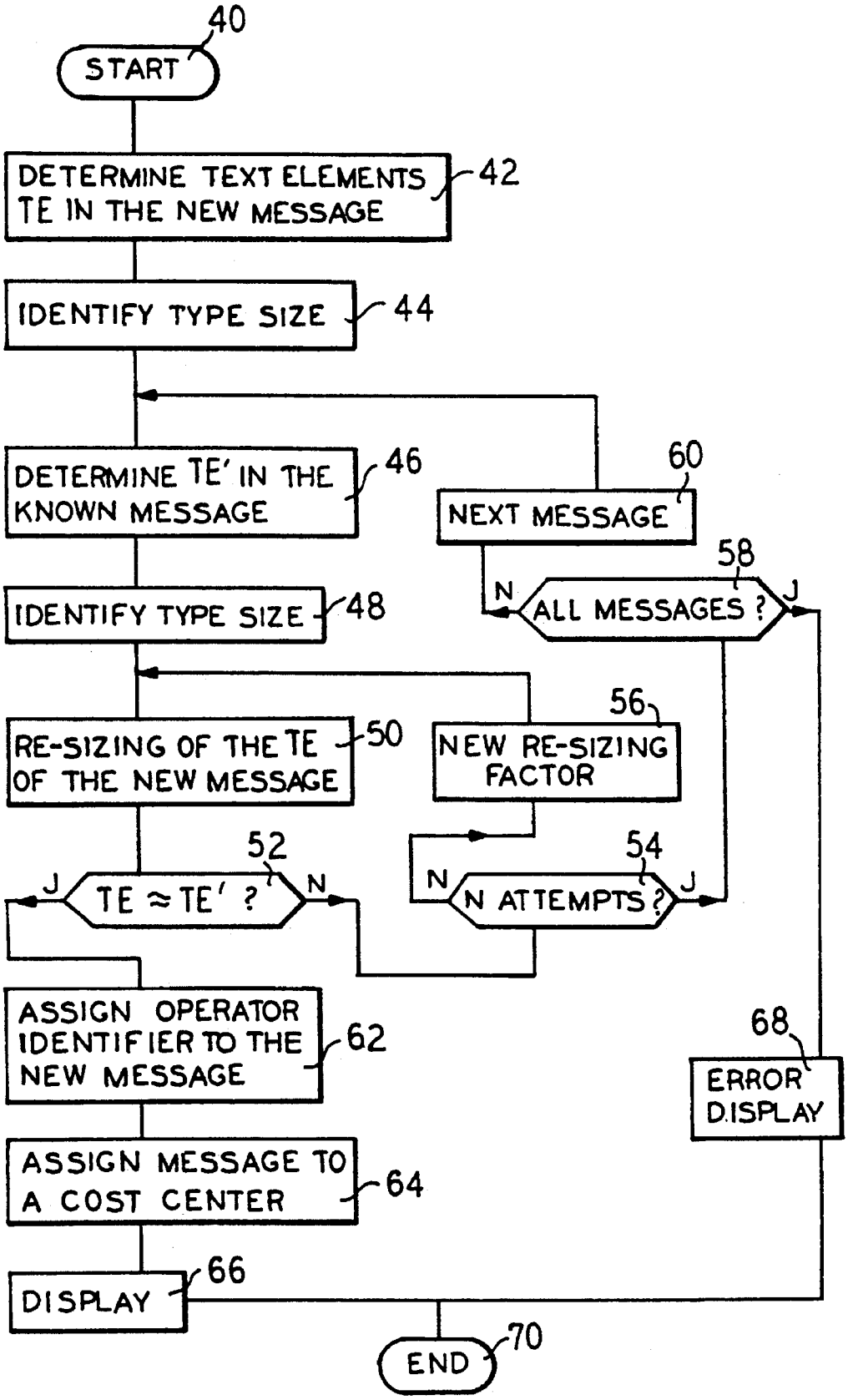
FIG. 5 is a flow chart of the method steps wherein a new message is allocated to a user.

FIG. 5 shows the method steps of an exemplary embodiment of the invention in the form of a flow chart. The method steps are stored in the read-only memory 22 (FIG. 3) as control instructions of a program. After the start of the program for setting a new message in the postage meter machine in step 40, the text elements contained in the new message are analyzed in step 42 in the present exemplary embodiment. To this end, the printing data of the message are converted into picture element data by the microprocessor 16, these being allocated to the message to be printed as a picture element matrix (pixel matrix) in the main memory 24. These picture element data are composed of binary values 0 and 1 that correspond to light or dark picture elements. Since the picture elements are transferred onto the postal matter column-by-column when printing in the postage meter machine, and consequently the text in the picture element matrix is constructed column-by-column, the transitions from light to dark picture elements and vice versa are identified column-by-column for seeking text elements in the message. The lengths of identical picture elements are also identified. Alphanumerical characters rarely have descenders (for example, y was omitted in the letters A, B, C, . . . , Z; a, b, . . . , x, z because of the existing descender), so that the connected underscores of a plurality of characters form a line and define a text line. The frequent appearance of a dark picture element in a specific column location in successive columns having regular interruptions for the spacings between the characters thus indicates the presence of a text line with high probability.

After a text line has been found, the type size of the text is identified in the next method step 44. To this end, the fact is utilized that the ascenders of a text represent the upper limit for the type height. In order to identify these ascenders, the spacing from dark-light transitions of the picture elements are identified in one or more columns proceeding from the underscoring of the letters which define a row line. The length thereby identified defines the type height, as may be easily seen, for example, in the case of the upper case letters B, E, F, etc., and in the case of the lower case letters b, f, h, etc. A direct conclusion about the type size can be drawn from the type height. In addition, the spacings between characters of a word or text line can be evaluated for identifying the type size.

In the next step 46, text elements in a message already present in the postage meter machine are identified in the same way. It is assumed that the postage meter machine was already equipped with messages for every user when the postage meter machine was delivered. The type size is also identified for the existing message (method step 48).

Subsequently, a re-sizing of the text elements of the new message is undertaken in method step 50. The size scale of the alphanumerical characters is modified in this re-sizing. Such re-sizing methods are known in the field of computer technology, for example in the display of images on picture screens, and need not be set forth in greater detail here.

In the next method step 52, the re-sized text elements of the new message are compared to those of the already existing message. The comparison can ensue on the basis of identical type sizes, i.e. the re-sizing factor is set such that the type size of the re-sized text elements the new message agrees with that of the previous message. In an iterative comparison method, an initial value of the re-sizing factor forms the point of departure and this is modified step-by-step within a prescribed range. For comparison, the picture elements of the respective picture element matrix of the text elements are compared to one another. If the binary values of the picture elements agree, this is interpreted as being a hit. If a predetermined hit quota, for example 80% of all picture elements in these sections, is exceeded in sections of the picture element matrices to be compared, then the agreement of the compared text elements with one another is determined and one proceeds to step 62. If this hit quota is not reached, then a branch is made to step 54 wherein the number of comparison attempts is determined and monitored. When the defined number n of attempts is not yet reached, then a new re-sizing factor with which the text elements identified in the new message are to be re-sized (method step 50) is set in step 56. Subsequently, the comparison on the basis of the picture element data is implemented again in step 52. The number of yet-to-be-examined messages is determined and monitored in step 58. When the number of attempts is equal to n, then a check is made in the to determine whether all existing messages have been examined. If this is not the case, then the next message is selected in step 60 and the method steps 46–52 are run through again.

When the hit quota identified in step 52 is adequately high, so that an agreement between the compared text elements has been found, then an operator identifier, i.e. a key element of the keyboard 30 upon whose actuation the new message can be called in is allocated to the new message in the following step 62. Subsequently, a specific cost center, i.e. the cost center of the existing message having the coinciding text element is allocated to the new message in step 64. Subsequently, a display that an allocation of the new message was possible is made on the display 32 in step 66.

When all existing messages have been processed in method step 58 without an agreement between text elements having been found, then an error display is produced in step 68. This error display informs the user that an automatic allocation of the new message was not possible and the employment of this message is not permitted by the postage meter machine. The method for automatically setting a new message is ended with method step 70; the program is departed.

Figure 6:
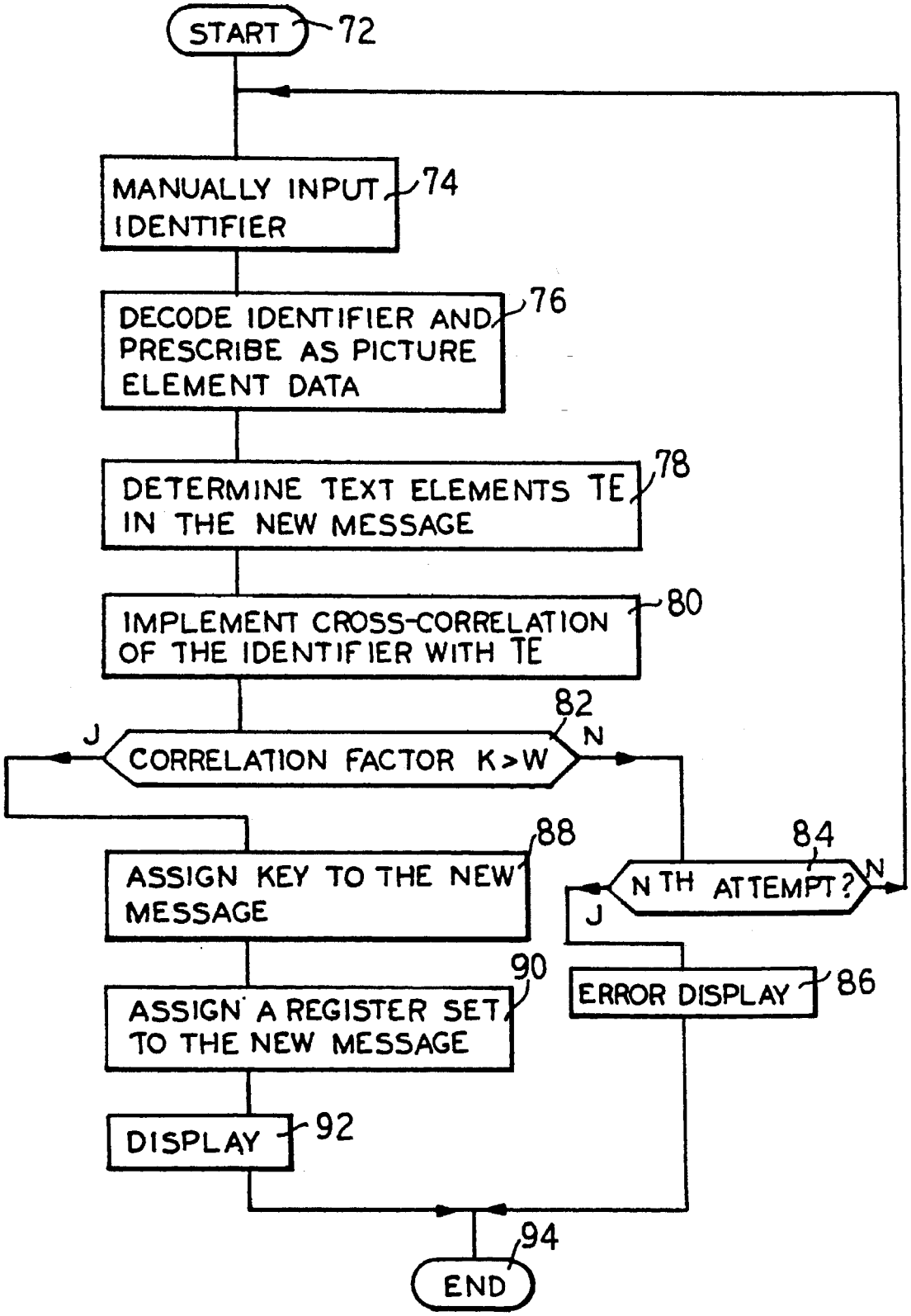
FIG. 6 illustrates the method steps of the allocation with manual entry of identifier information.

Method steps of a further exemplary embodiment of the invention are recited in a flow chart in FIG. 6, whereby the user manually enters information about the identifier of the new message (method step 74) via the keyboard 30 for setting a new message after the start in step 72. The alphanumerical characters that are entered are decoded and are arranged as picture element data in a picture element matrix in the main memory 24 (method step 76).

In the following step 78, the text elements contained in the new message are identified. To this end, the method steps described in FIG. 5 are employed. In the following step 80, the picture element data of the entered information are cross-correlated with the picture element data of the section of the new message having text elements and the correlation factor K is identified. When, in step 82, this upwardly exceeds a predetermined value W, for example 0.8, then this is evaluated as agreement between the input identifier and the identifier of the new message. A key of the keyboard 30 is allocated to the new message in step 88, the new message being activated when this key is actuated.

In the following step 90, a fee register set is allocated to the new message, this fee register set being in turn allocated to the user who manually entered the information about the identifier. It is also possible to allocate a fee register set to the user for the first time under this identifier in this condition of the method. Subsequently, the user is informed in step 92 that the setting of the new message has ensued properly.

When the correlation factor K identified in step 80 is too low, then the number of attempts is determined and monitored in step 84. If this lies below a defined number n, then method steps 74–82 are run through again. Otherwise, an error display regarding the impermissibility of an allocation is output in step 86. The method for setting the new message is ended in step 94 and a return to the main program is made as warranted.

It is also not absolutely necessary in the exemplary embodiment of FIG. 6 to respectively allocate a message to the various users of the postage meter machine at the factory. The setting of an initial message can alternatively be undertaken by the user in that the user manually enters an identifier that identifies him into the postage meter machine.

The exemplary embodiment of FIGS. 5 and 6 can be modified within the scope of the invention. For example, the comparison in the method of FIG. 5 in step 52 can also ensue on the basis of a cross-correlation. For reducing the outlay when seeking text elements in the message, the search can remain restricted to predetermined sections of the message, for example to the lower image section wherein the mailing address of the user is indicated such as, for example, in the message of FIG. 2. It is also possible to undertake the comparison not only on the basis of text elements but also on the basis of image elements. The exemplary embodiments of FIGS. 5 and 6 can also be combined with one another, whereby the comparison ensues either on the basis of messages already existing or on the basis of information that are manually input. In order to preclude manipulations, the comparison can ensue both on the basis of identifiers of existing messages as well as on the basis of input information.

Figure 7:
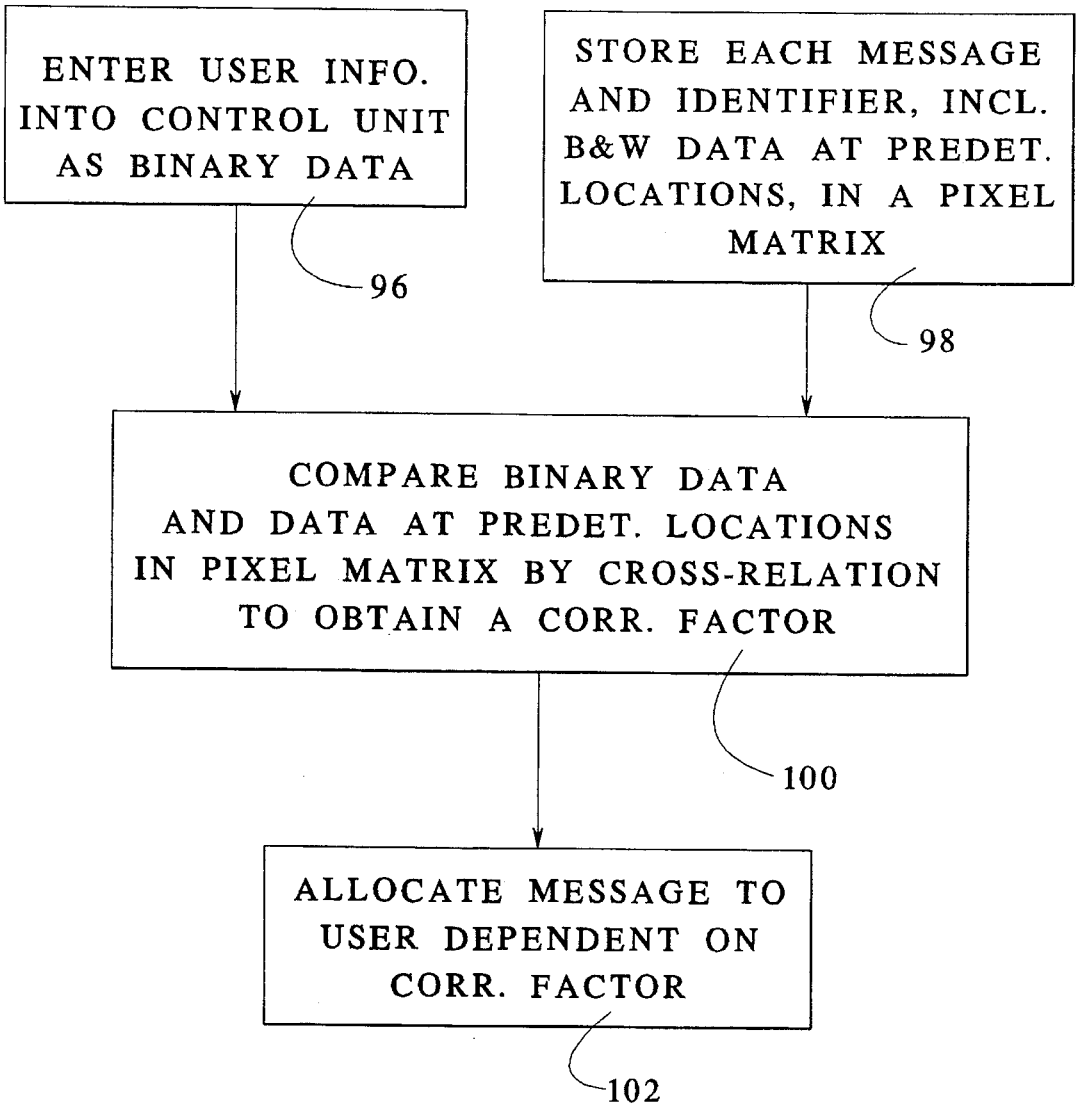
FIGS. 7, 8 and 9 respectively show three embodiments for allocating a stored message to a current user in accordance with the invention.
Figure 8:
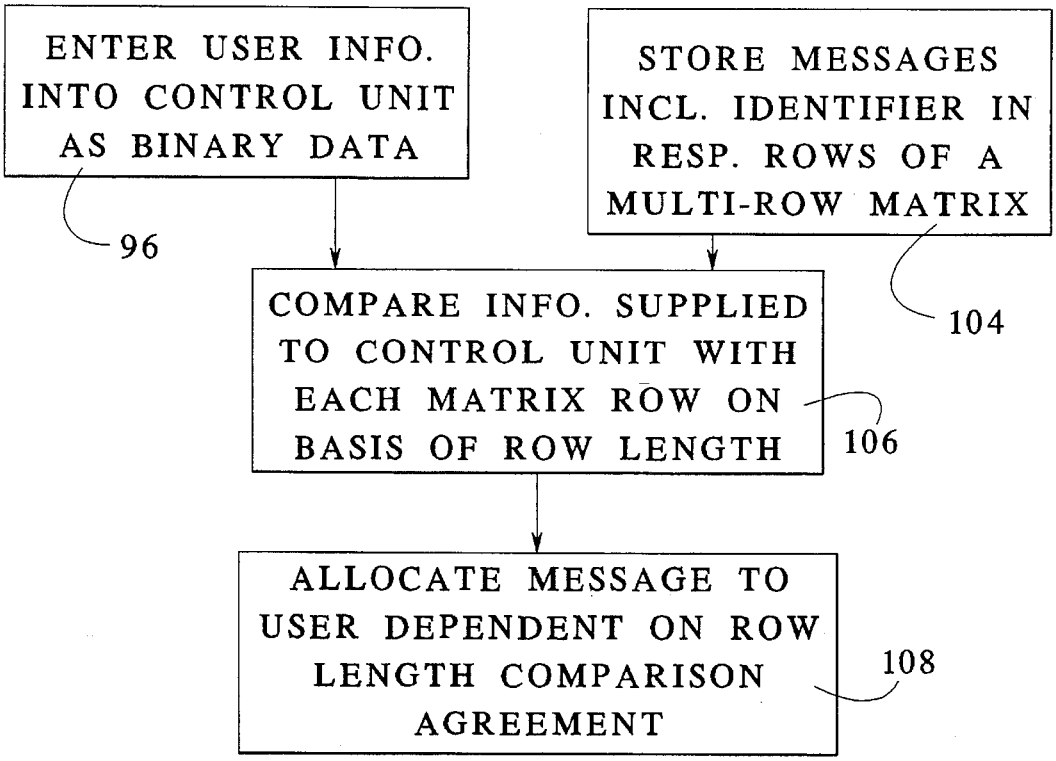
Figure 9:
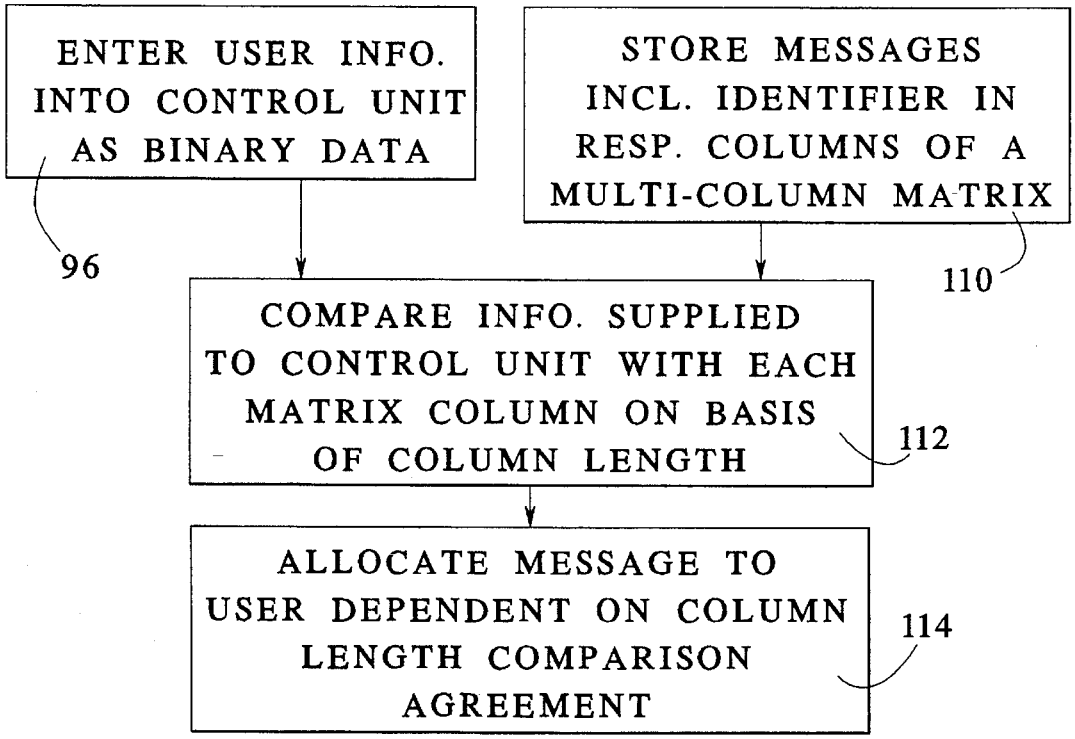

Three embodiments for allocating the proper one of the plurality of stored messages to a current user are respectively shown in FIGS. 7, 8 and 9. In the embodiment of FIG. 7, in step 96 the user information is entered into the control unit as binary data. In step 98 (accomplished previously), each message and its identifier was stored as black and white data in a pixel matrix, with at least some of the black and white data being stored in the pixel matrix at predetermined locations. In step 100, the binary data corresponding to the user information is compared with the data at predetermined locations in the pixel matrix to obtain a comparison result. This comparison may, for example, be a cross-correlation of the data in order to obtain a correlation factor. In step 102 one of the stored messages is allocated to the user dependent on the comparison result, for example, dependent on the correlation factor. In the embodiment of FIG. 8, in step 104, the messages are stored in respective rows of a multi-row matrix, and in step 106 a comparison takes place between the user information and each matrix row. This comparison can be, for example, on the basis of row length. In step 108, a message is allocated to the user dependent on the comparison result, such as dependent on agreement between the length of a particular row and the length of the binary data corresponding to the user information. FIG. 9 shows a similar embodiment, in steps 96, 110, 112 and 114, but wherein the messages are stored in respective columns of a matrix, and the comparison takes place on a column-by-column basis, such as by comparing column length with the length of the binary data.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for operating a postage meter machine jointly used by a plurality of users, said method comprising the steps of:

each user selecting at least one message to be printed on postal matter franked by that user;

incorporating an identifier which identifies the respective user into the message selected by said user;

providing a control unit in said postage meter machine with information pertaining to said identifier;

storing said message in said control unit in data form; and comparing said information pertaining to said identifier to the identifier in the message stored in said control unit and allocating said message to the respective user given agreement of said comparison, and printing said message with the identifier therein.

2. A method as claimed in claim 1 wherein the step of supplying said control unit with information pertaining said identifier comprising entering said information into said control unit via a manually operable data input unit.

3. A method as claimed in claim 1 wherein the step of supplying said control unit with information pertaining to said identifier comprises storing a previous message, including said identifier in said control unit.

4. A method as claimed in claim 1 wherein the step of incorporating an identifier in said message comprises incorporating an identifier into each message selected from the group consisting of at least part of corporate name, a company slogan or a company logo as said information pertaining to said identifier.

5. A method as claimed in claim 1 wherein said message and said information pertaining to said identifier include text elements, and wherein the step of comparing said information pertaining to said identifier and said message comprises comparing at least some of said text elements.

6. A method as claimed in claim 1 wherein the step of allocating said message to said user comprises permanently allocating said message to said user.

7. A method as claimed in claim 1 wherein the step of allocating said message to said user comprises allocating said message to said user for as long as that user is using said postage meter machine, and wherein said control unit is supplied with said information pertaining to said identifier upon each use of said postage meter machine by a user.

8. A method as claimed in claim 1 comprising the additional steps of:

providing a register set in said postage meter machine for each user of said postage meter machine in which fee-related data for that user are stored; and providing access to the register set for a user dependent on the allocation of said message to that user.

9. A method as claimed in claim 1 comprising the additional step of allocating at least one message to each user at a time of manufacture of said postage meter machine.

10. A method as claimed in claim 1 comprising the additional step of generating an error signal given a lack of agreement of said information pertaining to said identifier and said message.

11. A method as claimed in claim 1 wherein said message has a format size associated therewith and wherein said information pertaining to said identifier includes identifier elements having a format size, and wherein the step of comparing said information pertaining to said identifier and said message comprises comparing the format size of said information pertaining to said identifier with the format size of said message.

12. A method as claimed in claim 11 comprising the additional step, if said format size of said message is different from said format size of said information pertaining to said identifier, re-sizing one of said message or said information elements step-by-step and comparing said format size of said method with said format size of said information pertaining to said identifier after each re-sizing.

13. A method as claimed in claim 1 wherein the step of storing said message in said control unit comprises storing said message in said control unit as picture element data in a memory as a picture element matrix.

14. A method as claimed in claim 13 wherein the step of supplying said control unit information pertaining to said identifier comprises supplying said control unit with information in the form of binary data and wherein the step of comparing said information pertaining to said identifier and said message comprises cross-correlating said picture element data and said binary data to produce a correlation factor, and wherein said message is allocated to said user dependent on said correlation factor.

15. A method as claimed in claim 14 wherein said picture element data include dark picture elements and light picture elements at predetermined positions in said matrix, and wherein said binary data and said message are compared by cross-correlation using said picture elements at said predetermined positions.

16. A method as claimed in claim 1 wherein the steps of each user selecting a message and storing said message in said control unit comprise storing the selected messages for all users in respective rows of a matrix having a plurality of rows, and wherein the step of comparing said information pertaining to said identifier and said message is undertaken row-by-row.

17. A method as claimed in claim 16 wherein the step of comparing said information pertaining to said identifier with said message comprises comparing a row length of said message with a row length of said information pertaining to said identifier.

18. A method as claimed in claim 16 wherein the step of comparing said information pertaining to said identifier with said message comprises allocating said message to said user, and concluding said comparing, if agreement between said message and said information pertaining to said identifier occurs for a predetermined number of said rows.

19. A method as claimed in claim 1 wherein the steps of each user selecting a message and storing said message in said control unit comprise storing the selected messages for all users in respective rows of a matrix having a plurality of columns, and wherein the step of comparing said information pertaining to said identifier and said message is undertaken column-by-column.

20. A method as claimed in claim 19 wherein the step of comparing said information pertaining to said identifier with said message comprises comparing a column length of said message with a column length of said information pertaining to said identifier.

21. A method as claimed in claim 19 wherein the step of comparing said information pertaining to said identifier with said message comprises comparing a column length of said message with a column length of said information pertaining to said identifier.

* * * * *